US010195895B2

(12) United States Patent
Richard

(10) Patent No.: US 10,195,895 B2
(45) Date of Patent: Feb. 5, 2019

(54) INSERTER SEALER SYSTEM

(71) Applicant: Pitney Bowes Inc., Danbury, CT (US)

(72) Inventor: Craig D. Richard, Shelton, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 0 days.

(21) Appl. No.: 15/292,547

(22) Filed: Oct. 13, 2016

(65) Prior Publication Data

US 2018/0104978 A1 Apr. 19, 2018

(51) Int. Cl.

| | |
|---|---|
| ***B05D 1/28*** | (2006.01) |
| ***B43M 5/04*** | (2006.01) |
| ***B05C 11/10*** | (2006.01) |

(52) U.S. Cl.

CPC ..... *B43M 5/04* (2013.01); *B05C 11/10* (2013.01); *B05D 1/28* (2013.01)

(58) Field of Classification Search

CPC ..... B05D 1/28

See application file for complete search history.

(56) References Cited

U.S. PATENT DOCUMENTS 3,694,636 A * 9/1972 Smith, Jr. ..... G06N 99/005 700/149
4,924,805 A * 5/1990 O'Dea ..... B05B 12/12 118/323
5,527,418 A * 6/1996 Ginsberg ..... B43M 5/04 156/227
5,702,592 A * 12/1997 Suri ..... B01D 35/143 116/268
2006/0231023 A1* 10/2006 Angros ..... B01L 3/508 118/305
2007/0267441 A1* 11/2007 van Opstal ..... B67D 1/0025 222/129.4
2008/0029220 A1 2/2008 Gerhardt
2009/0252870 A1* 10/2009 Munneke ..... B43M 5/042 427/207.1

FOREIGN PATENT DOCUMENTS

EP 2106926 A1 10/2009
WO WO 02/068216 A1 6/2002

* cited by examiner

*Primary Examiner* — Nathan H Empie
(74) *Attorney, Agent, or Firm* — Michael J. Cummings

(57) ABSTRACT

An optimized system and method for application of liquid for moistening adhesive on envelope flaps as part of an automated mail production process. Envelopes with open envelope flaps are transported beneath a moistening brush so that an interior side of the flaps, having adhesive thereon, come into contact with a lower end of the moistening brush. A flow of liquid is provided from a liquid supply coupled to the moistening brush to keep the moistening brush wet as moisture is transferred to the envelope flaps. The rate at which liquid is regulated such that moisture is maintained on the brush and a selected quantity of liquid (a dose) is provided for each envelope flap that it moistened. The dose is automatically determined as a function of physical dimensions of the envelope flap, and to optimize sealing of the envelope without excess dripping.

8 Claims, 5 Drawing Sheets

INSERTER SEALER SYSTEM

FIELD OF THE INVENTION

The present invention relates to a system, device, and process for moistening envelopes as part of an envelope sealing operation in mail processing equipment.

BACKGROUND OF THE INVENTION

Mail processing systems, such as, for example, mailing machines, inserters and the like, often include different modules that automate the processes of producing mail pieces. The typical mail processing system includes a variety of different modules or sub-systems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a stripping/moistening module, i.e., stripping open the flap of an envelope, wetting and sealing the glued flap of an envelope, a weighing module, and a metering/printing module, i.e., applying evidence of postage to the mail piece. The exact configuration of the mail processing system is, of course, particular to the needs of the user.

The stripping/moistening module includes a stripping blade for separating a flap of a moving envelope away from the envelope's body to enable the moistening and sealing process to occur. The stripping blade becomes inserted between the flap of the envelope and the body of the envelope as the envelope traverses the transport deck of the mailing machine. Alternatively, in some devices, envelopes are stacked and fed into the system with their envelopes already opened. Regardless, with the flap opened, the moistening device moistens the glue line on the flap in preparation for sealing the envelope. One type of moistening system, known as a contact moistening system, generally deposits a moistening fluid, such as, for example, water or water with a biocide, onto the glue line on a flap of an envelope by contacting the glue line with a wetted applicator.

A conventional moistening system may include an applicator, typically formed from a contact media such as a brush, foam or felt. The applicator is supplied with moistening fluid, either through physical contact with a wick, a portion of which is located in a reservoir containing the moistening fluid, or via a pump system and tubing. As an envelope is transported with its flap open, the inside of the envelope flap, where the glue line for sealing the flap is located, contacts the applicator, such that the applicator transfers moistening fluid to the flap to activate the glue. The flap is then closed and sealed, such as, for example, by passing the closed envelope through a nip of a sealer roller to compress the envelope and flap together, and the envelope is passed to the next module for continued processing.

There are problems, however, with conventional moistening modules as described above. For example, efficient sealing of the envelope flap is dependent upon the envelope flap receiving sufficient moistening fluid transferred from the applicator to the glue line on the envelope flap. If the glue line on the envelope flap does not receive sufficient moistening fluid, the glue will not activate and the flap will not seal.

On the other hand, if there is too much moistening fluid in the applicator, then the applicator will drip, and there must be some means for dealing with the excess liquid. Excess liquid can overflow and make a mess, and it can result in the supply of moistening fluid running out prematurely. In order to address these issues in the past, one technique has been for operators to use trial and error to adjust a valve to modify the flow of liquid to the applicator.

Another potential issue is uneven distribution of liquid from the applicator. Sometimes one part of the applicator may be more wet than another, resulting in uneven moistening of the envelope flap, potentially causing the sealing operation to be unsuccessful, or for excessive dripping from the region of the applicator that gets too much liquid.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

The invention provides an improvement for optimized application of liquid for moistening adhesive on envelope flaps as part of an automated mail production process. Envelopes with open envelope flaps are transported beneath a moistening brush so that an interior side of the flaps, having adhesive thereon, come into contact with a lower end of the moistening brush. In this way, moisture is transferred from the moistening brush to the interior side of the flaps.

A flow of liquid is provided from a liquid supply coupled to the moistening brush to keep the moistening brush wet as moisture is transferred to the envelope flaps. The rate at which liquid is supplied to the moistening brush is regulated with a controlled pump. The flow is regulated such that moisture is maintained on the brush. A selected quantity of liquid (a dose) is provided for each envelope flap that it moistened. The dose is automatically determined as a function of physical dimensions of the envelope flap. The dose is chosen so that it is adequate for sealing the envelopes. However, the dose is also limited so that the brush does not drip, and so that there is only a nominal amount of excess liquid.

In the preferred embodiment, the dose is determined based on the physical dimensions corresponding to height, width, and slope of the envelope flap. In such an embodiment, the dosage calculation is done with a general formula that is applicable to a range of different envelopes having different flap dimensions that may typically be used in a mail production system. Experimental measurements are taken to determine the preferred dosage to achieve ideal envelope sealing while avoiding excess liquid dripping from the brush. Using this data, the general formula is preferably determined by a least squares analysis that determines parameter values for the formula to correspond to measured data. The parameter values can be determined in the least squares analysis by minimizing a difference between the measured data for optimal dosage for the different envelope types and calculated values using the general formula with the parameter values.

In another preferred embodiment, an auto-priming operation is performed after a predetermined idle time in which liquid has not been supplied to the brush. The auto-prime operation includes supplying liquid to the brush so that the brush is fully saturated. Then a series of empty waste envelopes is run beneath the brush to remove any excess liquid prior to resuming normal operation. In the preferred embodiment, the number of waste envelopes to be run is the numerator five (5) divided by the dose, where the dose is expressed as a fraction of a cycle of the controlled pump.

The preferred embodiment also includes a preferred circuit for delivery of the liquid to the brush. This liquid circuit includes a tank for storing the liquid for the system. Liquid from the tank is filtered by a filter coupled to the outlet of the tank. A pressure sensor senses the liquid pressure at both the filter inlet and filter outlet. A flow sensor, positioned downstream of the pressure sensor, senses liquid flow on its way to the brush.

In a preferred embodiment, a signal from the pressure sensor port at the filter inlet is scaled and processed in the controller to correspond to a liquid level in the tank. A "liquid level low" error signal is generated when a pressure at the filter inlet goes below a predetermined threshold. Also a differential pressure is measured across the filter inlet and filter outlet. A "filter clogged" error signal is provided when the differential pressure goes above a predetermined threshold.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 1:
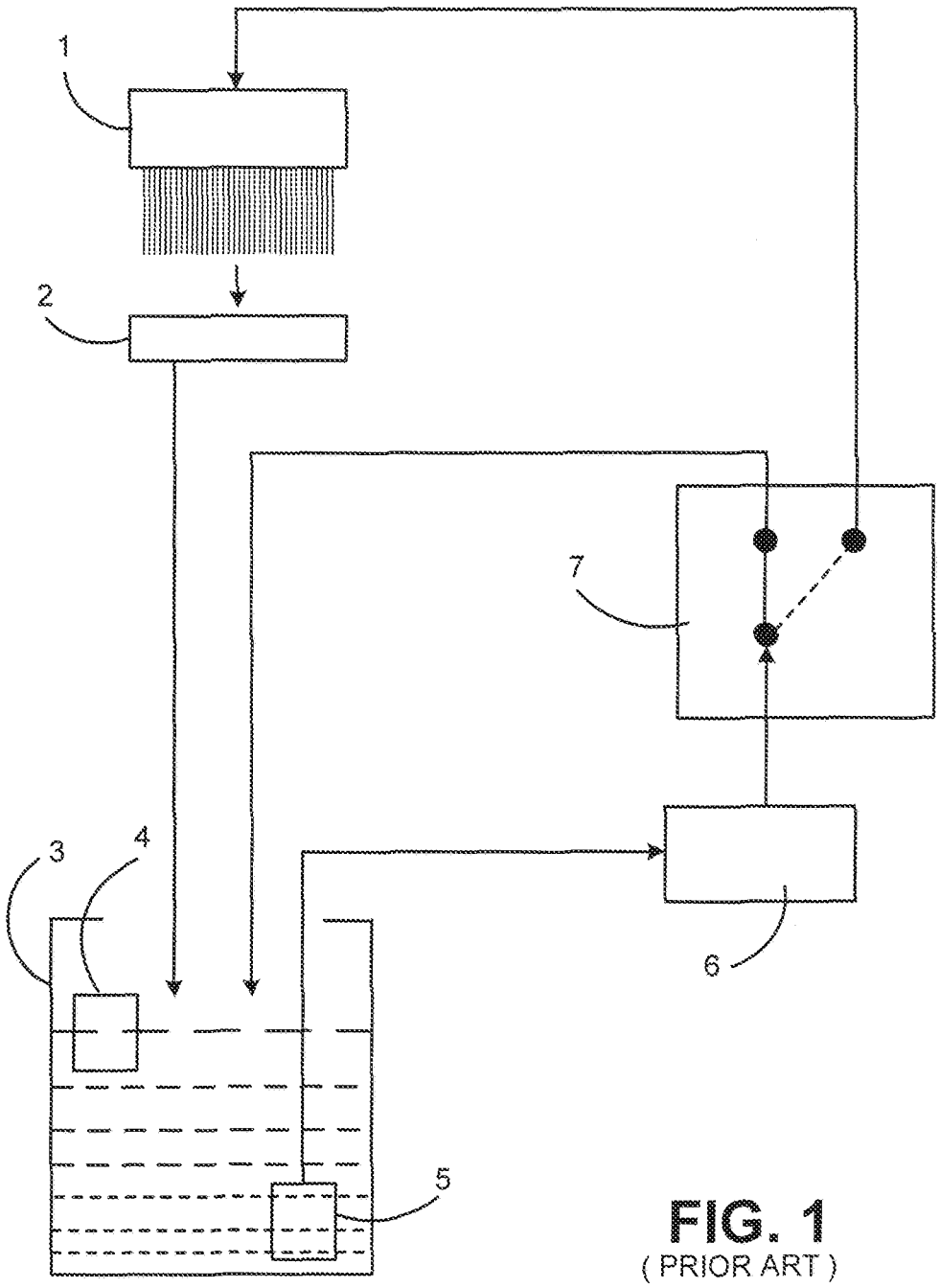
FIG. 1 ( PRIOR ART )
FIG. 1 depicts a prior art version of a flow circuit for a moistening system.

FIG. 1 depicts a prior art circuit for providing liquid to a moistening brush 1. In this circuit, the flow of liquid is not accurately controlled, so there is a high likelihood that excess liquid will be provided to the brush 1. As a result, excess liquid will drip from the brush 1 into a drip collector 2. In this embodiment, the excess liquid is drained back into the tank 3. A tank level float 4 provides an indication of the liquid level in the tank. A filter 5 is positioned at the tank outlet to remove any impurities in the liquid before it is pulled away by pump 6. A two-way solenoid switch 7 is controlled to adjust the flow of liquid. When the prior art system is in operation, the switch is placed in an on position (dotted line) and liquid is provided to the brush 1. When the system is not in operation, and liquid is not needed at the moistener, then the switch is turned to an off position (solid) and the liquid flow can be recirculated into the tank 3.

Figure 2:
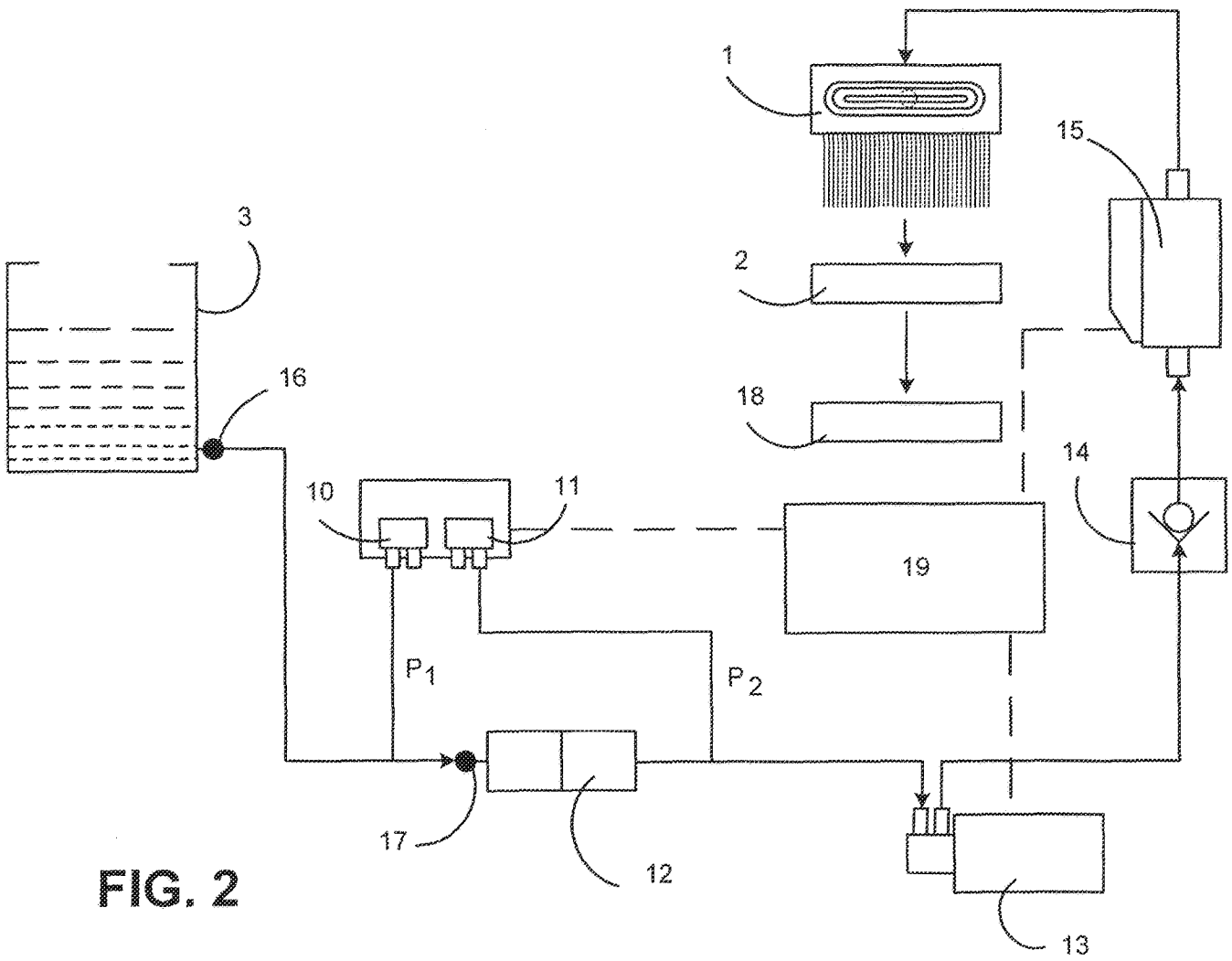
FIG. 2 depicts an improved liquid flow circuit for use in a moistening system.

FIG. 2 depicts a moistening liquid circuit that may be preferably used with the present invention. This circuit does not include a feedback loop to the tank 3 because the moistening liquid is more carefully controlled. Also, allowing liquid to flow back into the tank increases the likelihood that impurities will contaminate the liquid and require more frequent changing of the filter, or cleaning of the tank 3.

In this preferred circuit, the tank 3 is attached by tubing at a tank outlet fitting 16, to a filter 12, via a filter fitting 17. A pressure sensor 10 is positioned to detect the liquid pressure on either side of the filter 12. An upstream pressure P1 is preferably measured as positive pressure upstream of the filter 12. A downstream pressure P2 is preferably measured as negative pressure downstream of the filter 12. This pressure sensor 10 arrangement, in communication with controller 19, allows detection of various error conditions that can occur.

Pressure sensor 10 utilizes pressures P1 and P2 to detect the amount of liquid in supply tank 3, whether fittings 16 and 17 are disconnected, and whether the filter 12 is clogged. For example, when the P1 pressure signal is below a low tank pressure threshold, and negative pressure P2 is also below a nominal threshold, then controller 19 issues a "tank low" warning, and an appropriate message can be shown on a display for an operator to take appropriate action.

In another example, when P1 is below a nominal pressure signal, and negative pressure P2 is above a high threshold, then that indicates that tank fitting 16 may be disconnected. Upon occurrence of this condition, the controller 19 will preferably stop the system from running until the error condition has been corrected.

In another example for detecting a disconnected fitting, when P1 remains above a nominal pressure signal, and negative pressure P2 is above a high threshold, then that indicates that filter fitting 17 may be disconnected. Upon occurrence of this condition, the controller 19 will again preferably stops the system from running until the error condition has been corrected.

In a third example, a clogged filter is can be detected by cumulative adding a signal proportional P1 with the negative pressure P2. If that signal exceeds a predetermined threshold, then a "filter clogged" warning is generated by controller 19 and an appropriate warning is displayed to the operator. In this example, a clog in filter 12 is inferred because the pump 13 should not be drawing a strong vacuum at P2 when there is also adequate water pressure at P1, unless there is some obstruction within the filter 12.

Downstream of the filter 12, a solenoid pump 13, in communication with controller 19, drives the flow of liquid in the system. A check valve 14 downstream of pump 13 ensures the flow of liquid in the proper direction.

A flow sensor 15, downstream of the check valve 14, detects the flow of liquid in the system. The flow sensor 15, in communication with the controller 19, is used to ensure that the expected pulse of liquid flow is seen for each cycle of the pump 13. An error condition is indicated by the controller 19 when the expected flow is not seen, within a predetermined margin of error. In the preferred embodiment, the flow sensor 15 detects if a pump 13 pulse has occurred, as expected. If no pulse is detected for a predetermined number of pulses, then an error condition is generated by the controller 19, and the system is halted.

Finally, as seen in FIG. 2, the liquid flows to the brush 1. There is a drip collector 2 and a drip tray 18 below the brush, but under the preferred mode of operation, very little excess liquid should collect in those components, and it is expected that most of the excess generated by this system can evaporate on its own. Dripping would be most likely to occur at startup when the brush 1 is provided with a large amount of liquid so that it is fully saturated.

This arrangement of sensors and components as depicted in FIG. 2 serves to minimize a quantity of sensors needed to monitor status at the various locations in the hydraulic system. A more typical solution would involve a distinct sensor for each process to be measured. In the preferred arrangement, however, the sensors may contribute to detecting more than one type of problem.

Figure 3:
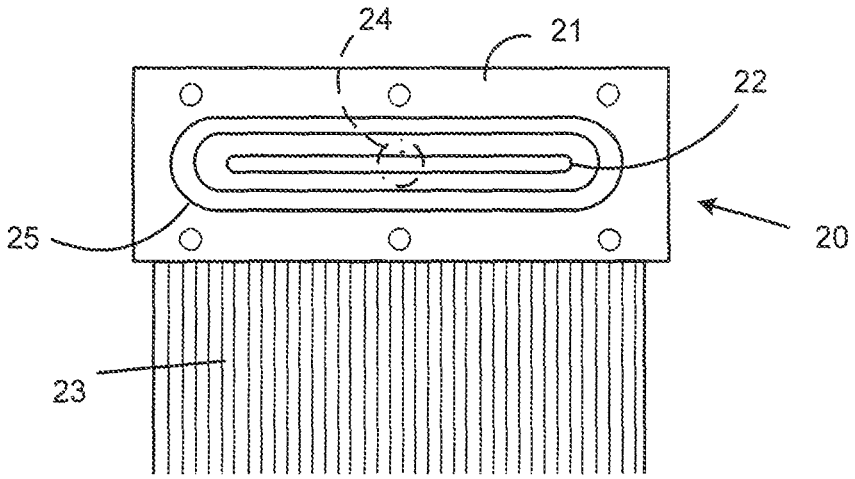
FIG. 3 shows a view of a moistener brush for use with the improved system.

FIG. 3 depicts an improved brush 20 for use in the improved moistening system. A brush housing 21 encloses moistening bristles 23, as is conventionally known. In the conventional arrangement, liquid is supplied onto the bristles through a hole 24 in the housing 21. However, in the improved arrangement shown in FIG. 3, a channel slot 22 extends across a width of the brush 20. This channel 22 addresses the problem of uneven distribution of liquid throughout the bristles 23. In the conventional arrangement, only a portion of the cross-section of the brush 20 may have been adequately wet for moistening and sealing envelopes. In such conventional arrangement, liquid was pumped to the top of the brush, but the majority of liquid would flow through the center and drip from the center at the bottom of the brush.

Figure 5:
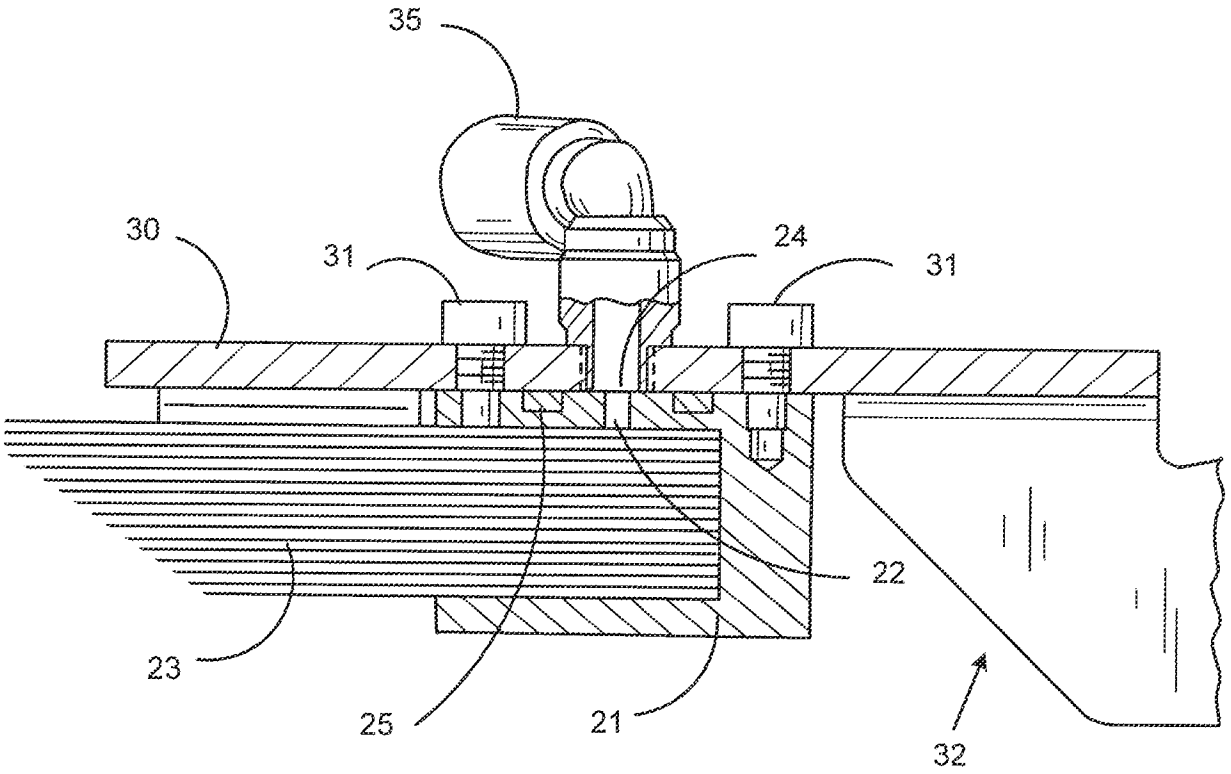
FIG. 5 is a side view of the moistener assembly.

In the preferred arrangement of FIG. 3, fluid enters the brush 20 through hole 24, which receives fluid from fitting 35. The fluid enters the channel slot 22 and is distributed evenly across the width of the brush 20. This channel causes equal distribution of fluid in the brush 20 and prevents certain spots from becoming over-saturated and dripping. This allows the brush 20 to be able to wet envelope flaps more evenly, and helps conserve fluid and avoid having excess liquid that needs to be removed or recirculated. As seen in FIGS. 3 and 5, the o-ring 25 serves to seal the brush holder 30 against the brush housing 21, and further prevents dripping.

Figure 4:
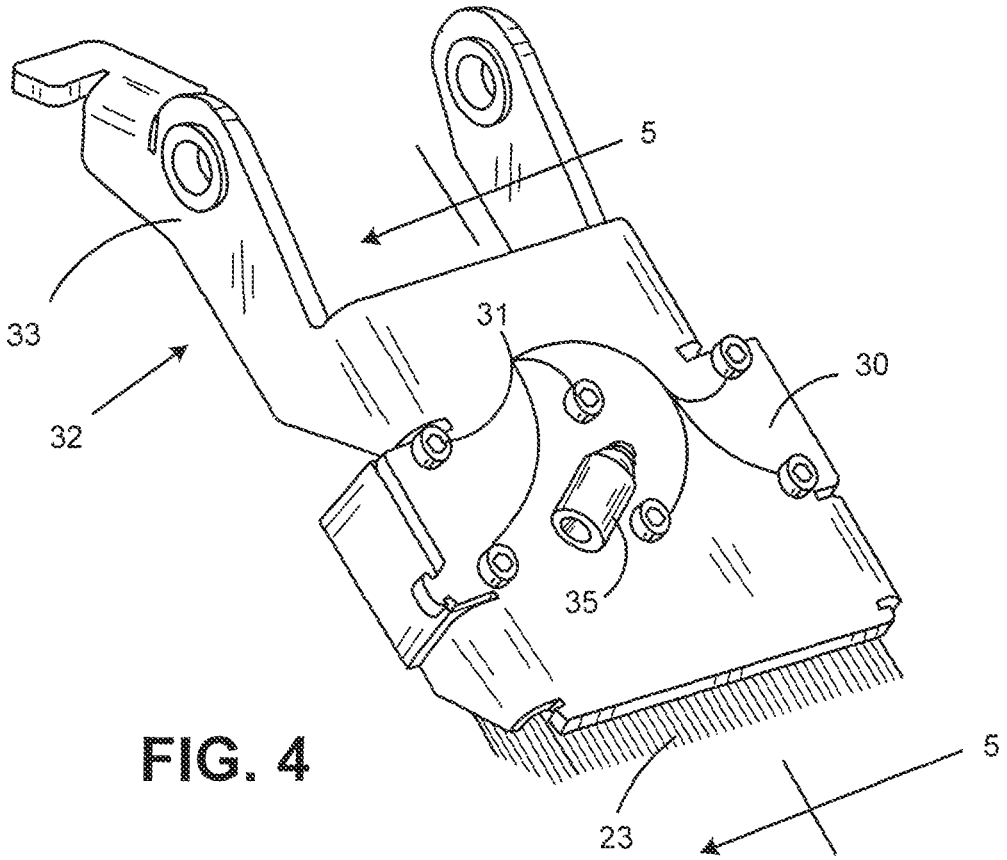
FIG. 4 is an isometric view of the moistener assembly.

Referring to FIGS. 4 and 5, brush 20 is mounted on brush holder 30 with fasteners 31 that extend through the brush holder 30 into brush housing 21. Water is supplied through a tube to a fitting 35 which is fitted into a hole 24 in the brush holder 30. When the brush 20 is mounted in the holder 30 the hole 24 is contiguous with the slot channel 22 for even distribution of liquid, and o-ring 25 seals the connection.

Figure 6:
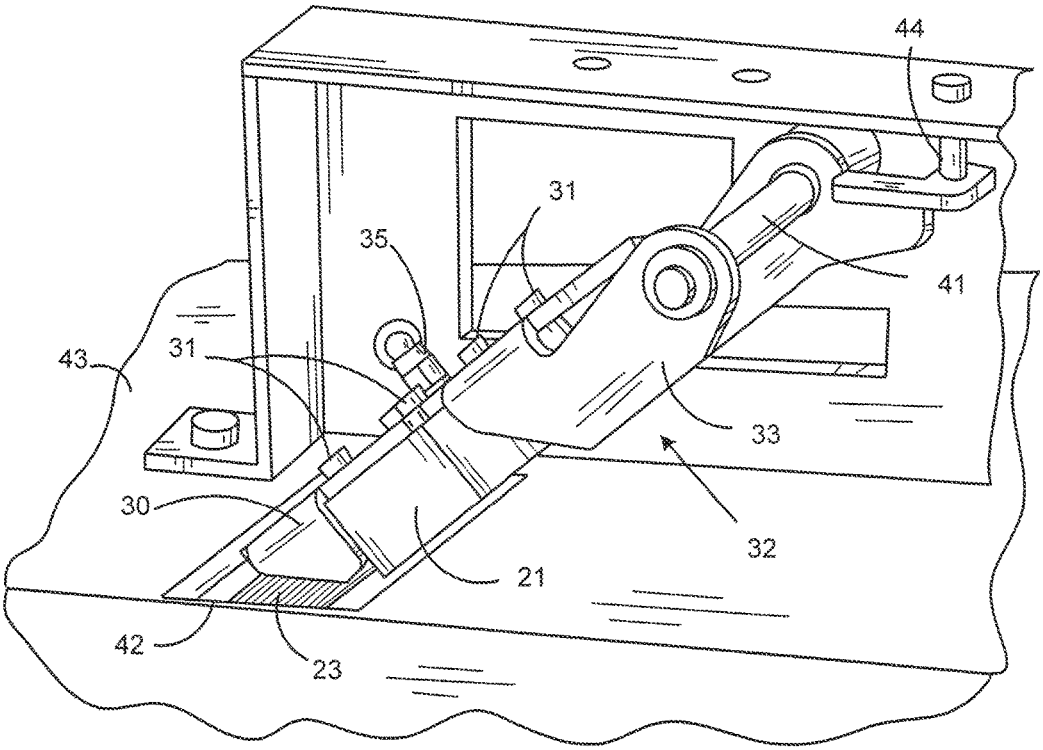
FIG. 6 is a further isometric view of the moistener assembly showing positioning and mounting in the system.

As seen in FIG. 6, the mounting and arrangement of the brush assembly 32 provides further improvements and advantages. The first is that the sheet metal mounting bracket 30 wraps around the bristles 23, preventing them from being able to bend completely. This support helps prevent the brush bristles 23 from permanently becoming curved from the impact of mail pieces.

A second advantage is that the bristles 23 are not in contact with the surface below it. There is a cutout 42 in the deck 43 which allows the bristles 23 to not have any force on them when the machine is not running mail. This helps prevent the bristles 23 from taking a set, and prevents water from draining/dripping out of the brush 20 due to surface tension.

A third problem solved is that the brush assembly 32 is allowed to pivot to allow for 'bad' mail pieces to be able to pass under the brush without creating a jam. The brush assembly 32 includes support arms 33 that are rotatably mounted on a shaft 41. The brush assembly 32 is loaded with a spring such that the brush 20 does not move during normal operation, but is able to pivot around shaft 41 out of the way in extreme cases where large blockages are passing through, and jams are avoided.

A fourth problem solved is the ability to adjust the brush assembly 32. Brushes are often hand trimmed, and they frequently vary in length. This variation in length, along with the fact that the brushes wear in and change shape over time, makes it such that the brush needs to be adjustable. To adjust the brush a screw 44 is used. The farther the screw 44 is inserted, the higher the brush assembly 32 sits as the arms 33 pivot around shaft 41.

A further improvement to the moistening system is directed to the control of the flow liquid to the brush so that an optimal amount of moisture is provided. This improvement takes the guesswork and trial and error out of determining the amount of water needed to properly seal an envelope. Old methods require the operator to manually enter the amount of time a valve is open, which is used to direct the flow of water onto the envelope flap.

In the improved system, a preferred dose of liquid is calculated. A generic formula is applied that takes into account the dimensions of the envelopes for determining the appropriate dose. The "sealer dose" or "dose" is the amount of liquid pumped into the sealer brush 20 each time an envelope flap passes under it. This dose is based on the amount of water the sealer pump 13 outputs on each stroke of the pump 13. In a preferred embodiment, the pump 13 will output 80 uL of water per pulse, and the dose is expressed as a fraction of this amount for purposes of these calculations. Thus, for example, a dose of "0.5" will be equal to 40 uL of water on each envelope.

There is an upper and a lower bound on the amount of water each envelope can receive. Too much water will cause the sealer brush to drip, filling the drip tray. Too little water will cause the envelopes to seal poorly as the glue is not fully wetted. The ideal dose for each envelope exists just below the amount that causes the brush 20 to drip. In a preferred embodiment, due to measurement errors and variability of the system, a dose with a decent margin under the ideal dose will be selected.

Empirical testing is done on a variety of different envelopes, having different sized envelope flaps. To determine the ideal dose, the following test was conducted for each different type of mail piece. The dose was manually set to a number that should make the brush drip and run 200 to 300 pieces of mail. The dose was lowered by 0.05 increments until the brush no longer drips and run 200 to 300 pieces of mail each time. The dose is recorded at which the brush stops dripping. This is the upper bound of an acceptable dose.

Then the dose is lowered by 0.05 increments until the mail starts to seal poorly. Fifty to one hundred pieces of mail each time for this. The dose is recorded for which the envelope flap is ideally sealed. Next, the dose is measured and recorded for which the envelope flap is just beginning to be poorly sealed. This will be the lower bound of an acceptable dose for that kind of envelope.

Figure 7:
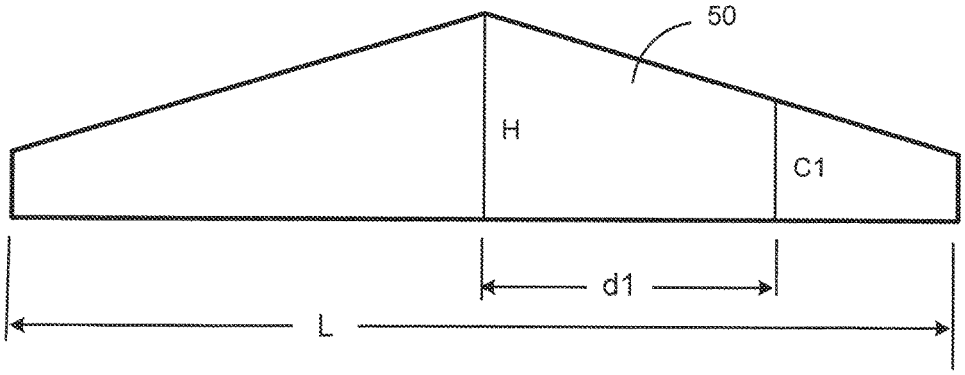
FIG. 7 shows an exemplary envelope flap having dimensions to be measured in accordance with the improved system.

As seen in FIG. 7, the preferred method for calculating dose uses three known dimensions of the envelope flap:

L—the length of the envelope flap

H—the height of the envelope flap

C1—the height of the envelope flap located d1 or 73 mm away from the center of the envelope These dimensions are only selected for convenience, and any other combination of dimensions that generally are indicative of the area of the envelope flap should suffice. For purposes of this example, it should be understood that dimension C1 substitutes as an approximation for a slope of the envelope flap.

The goal of this exercise is to write a generic equation that will provide an approximation of a satisfactory dose, as observed by the empiric tests, based on the measured dimensions. In the preferred embodiment, an equation is used that relates the value we are trying to determine (Dose) with the known variables (L, H, C1):

$$\text{Dose}=a*L+b*H+c*C1$$

In this exemplary equation, a, b, and c are constant variables that are meant to reflect the significance of those respective physical properties in determining the proper dose. This equation is only linear and will be limited in its accuracy. In a preferred embodiment, the order of this equation is increased to improve accuracy.

Adding second and third order terms:

$$\text{Dose}=a_1*L+b_1*H+*C1+a_2*L^2+b_2*H^{2+c}{}_2*C1^2+a_3*L^3+b_3*H^3+c_3*C1^3 \ldots +d$$

Or in summation form where any order can be used $$\text{Dose}=\Sigma_{n=1}{}^{i}a_nL^n+\Sigma_{n=1}{}^{j}b_nH^n+\Sigma_{n=1}{}^{k}c_nC1^n+d$$

A "Least Squares" method is used to determine the values of the variables that will cause the generic equation recited above to match the empirical data that was collected using the testing technique also described above. The goal of the least squares method is to find the parameter values (a's, b's and c's) for the model (the dose equation) which best fits the empirical data (the ideal dose values).

Using this method, the optimum is found by minimizing the sum, S, of the square of the weighted residuals.

$$S=\Sigma_{i=1}{}^{n}(w_i*r_i)^2$$

A residual is the difference between the experimental data and the calculated value found. In this case the residual is the difference between the ideal dose and the value found using the dose equation.

In the preferred implementation, a software tool, like Microsoft Excel, is used to solve the least squares problem. Using Excel, the first step is to create a table of all the known experimental data. The known values are put into columns with rows for each of the different types of envelopes. It is also helpful to add the upper and lower bounds that were experimentally determined. These will be used as a guide for determining the weights later on.

The preferred implementation also includes a weighting calculation to ensure that envelope types that require more precise dosages are given more importance in the calculation. Therefore, a column should be added in Excel for the weight of each residual. In this case, the weight is calculated by the following $$\text{weight}=\frac{1}{\text{Ideal Dose}}*\frac{1}{\text{Upper Bound}-\text{Lower Bound}}$$

The weight is inversely proportional to the Ideal Dose because as the dose gets smaller, the calculated value needs to be more accurate for it to be within the upper and lower bounds. Also, the weight is inversely proportional to the difference of the bounds because of the same reason stated previously In performing this calculation, a goal is to minimize the value of the weighted squared error by changing the values of the parameter constants (a,b,c,d). To help us find this minimum, the Excel Solver function is preferably used.

Following this process, using the preferred embodiment and system as described above, the following solution was derived:

$$\text{Dose}=\Sigma_{n=1}{}^{1}a_nL^n+\Sigma_{n=1}{}^{3}b_nH^n+\Sigma_{n=1}{}^{3}c_nC1^n+d$$

$$\text{Dose}=2.5838*L+235.06*H+-4887.6*H^2+33573*H^3+290.43*C1+-9841.9*C1^2+108660*C1^3+-6.7775$$

The units for this solution require input of the dimensions in meters, and as mentioned above, the dosage is given in a fraction of pump cycle, where one pump cycle provides 80 uL of liquid. For different types of commonly used #10 commercial envelopes, having various flap configurations, this equation results in doses that vary between 0.18 and 0.46. These results can be compared to the upper and lower bounds that were found by experimentation, and the results are validated when the calculated dosage falls within those bounds.

Thus a generic formula for determining moisture dosages for wetting envelopes is provided. This technique can also be applied in different systems having different components having different characteristics, and the calculated dosages will be different, but the inventive principles described herein will be the same.

A further enhancement that takes advantage of the precise dosage calculations is automatic priming of the brush. An envelope sealing brush needs to maintain a certain amount of water to function properly. After a long period of no usage, the brush may become too dry to wet the envelopes properly. Therefore, a method for automatically wetting the brush is needed.

The preferred auto prime technique is a method where, after a certain interval of time passes, the envelope sealing brush is wetted to a level past saturation. Past saturation means that the brush has too much water in it causing it to drip out the excess water. This past saturation level is achieved by putting in more water than the brush can hold, making it such that the previous state of the brush does not matter.

Once the brush is fully wetted, a certain number of empty envelope flaps (proportional to the area of the envelope flap) are then run under the brush. These envelope flaps soak up the excess water leaving the brush in an ideal state for sealing envelopes. The formula for the correct number of empty waste envelopes is as follows:

$$\#\text{Empty Envelopes}=\frac{5}{\text{Dose}},\ \text{where}$$

$$\text{Dose}=\text{amount of water applied per envelope}$$

Preferably, this auto priming process takes place whenever the machine sits idle for more than 3 hours. Once 3 hours of idle time has been reached, the machine will auto prime once the operator hits start. The pump will saturate the brush and then run a calculated amount of empty envelopes, out sorting them immediately.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method for optimized application of liquid for moistening adhesive on envelope flaps as part of an automated mail production process; the method comprising:

transporting open envelope flaps beneath a moistening brush so that an interior side of the flaps, having adhesive thereon, come into contact with a lower end of the moistening brush, thereby transferring moisture from the moistening brush to the interior side of the flaps;

providing a flow of liquid from a liquid supply coupled to the moistening brush to keep the moistening brush wet as moisture is transferred to the envelope flaps;

regulating a rate at which liquid is supplied to the moistening brush with a controlled pump included in the liquid supply, a flow of liquid to the brush regulated such that moisture is maintained on the brush and a selected quantity of liquid (a dose) is provided for each envelope flap that it moistened, and wherein the dose is automatically determined as a function of physical dimensions of the envelope flap, and the dose is adequate for sealing the envelopes, but less than an amount where the brush would drip; performing an auto-priming operation after a predetermined idle time in which liquid has not been supplied to the brush; and wherein the auto priming operation comprises causing the controlled pump to supply liquid to the brush so that the brush is fully saturated with liquid and then causing the system to moisten a series of waste envelopes to remove any excess liquid prior to resuming normal operation.

2. The method of claim 1 wherein the step determining the dose is based on the physical dimensions corresponding to height, width, and slope of the envelope flap.

3. The method of claim 2 wherein the step of determining the dose is further based on a general formula that is determined by a least squares analysis that, determines parameter values for the formula to correspond to measured data for optimal dosages for a variety of different envelope types having different flap dimensions.

4. The method of claim 3 wherein the parameter values are further determined in the least squares analysis by minimizing a difference between the measured data for optimal dosage for the different envelope types and calculated values using the general formula with the parameter values.

5. The method of claim 1 wherein the auto-priming operation further comprises: wherein the number waste envelopes to be run is numerator five divided by the dose, where the dose is expressed as a fraction of a cycle of the controlled pump.

6. The method of claim 1 further including:

storing liquid in a tank having a tank outlet for supplying liquid for moistening;

filtering liquid from the tank with a filter coupled to the outlet of the tank for removing impurities in the liquid from the tank, the filter having a filter inlet and a filter outlet;

sensing pressure with a pressure sensor having sensor ports coupled at both the filter inlet and filter outlet, the pressure sensor in operative communication with a controller;

sensing liquid flow with a flow sensor in operative communication with the controller, positioned downstream of the pressure sensor, and through which liquid passes on its way to the brush.

7. The method of claim 6 wherein a signal from the pressure sensor port at the filter inlet is scaled and processed in the controller to correspond to a liquid level in the tank, and providing a "liquid level low" error signal when a pressure at the filter inlet goes below a predetermined threshold.

8. The method of claim 6 including measuring a differential pressure across the filter inlet and filter outlet with pressure sensor, and providing a "fitter clogged" error signal when the differential pressure goes above a predetermined threshold the tank, and providing a "liquid level low" error signal when a pressure at the filter inlet goes below a predetermined threshold.

* * * * *